US012426672B2

(12) United States Patent
Oleson et al.

(10) Patent No.: US 12,426,672 B2
(45) Date of Patent: Sep. 30, 2025

(54) SEGMENTED SOLE FOR FOOTWEAR

(71) Applicant: LULULEMON ATHLETICA CANADA INC., Vancouver (CA)

(72) Inventors: Mark Arthur Oleson, Portland, OR (US); Michael Andrew Notrica, Portland, OR (US); Christopher Ka-Yin Lam, Portland, OR (US); Donald Taylor Johnston, Portland, OR (US); Peter Rueegger, Portland, OR (US); Simon Markus Luthi, Lake Oswego, OR (US); Michael Steszyn, Portland, OR (US)

(73) Assignee: Lululemon Athletica Canada Inc., Vancouver (CA)

( * ) Notice: Subject to any disclaimer, the term of this patent is extended or adjusted under 35 U.S.C. 154(b) by 255 days.

(21) Appl. No.: 17/639,235

(22) PCT Filed: Aug. 28, 2020

(86) PCT No.: PCT/CA2020/051183
§ 371 (c)(1),
(2) Date: Feb. 28, 2022

(87) PCT Pub. No.: WO2021/035363
PCT Pub. Date: Mar. 4, 2021

(65) Prior Publication Data

US 2022/0295940 A1 Sep. 22, 2022

Related U.S. Application Data

(60) Provisional application No. 62/894,653, filed on Aug. 30, 2019.

(51) Int. Cl.
*A43B 13/14* (2006.01)
*A43B 5/06* (2022.01)
(Continued)

(52) U.S. Cl.
CPC ..... *A43B 13/141* (2013.01); *A43B 5/06* (2013.01); *A43B 13/04* (2013.01); *A43B 13/122* (2013.01); *A43B 13/148* (2013.01); *A43D 27/02* (2013.01)

(58) Field of Classification Search
CPC ..... A43B 13/141; A43B 13/04; A43B 13/148; A43B 13/122; A43B 5/06; A43B 7/1495; A43D 27/02
(Continued)

(56) References Cited

U.S. PATENT DOCUMENTS 4,309,832 A 1/1982 Hunt
4,562,651 A * 1/1986 Frederick ..... A43B 13/141 36/102
(Continued)

FOREIGN PATENT DOCUMENTS

EP 3009022 A1 4/2016

OTHER PUBLICATIONS

International Search Report and Written Opinion of the International Searching Authority from the Canadian Intellectual Property Office, in PCT/CA2020/051183 dated Nov. 26, 2020, which is an international application corresponding to this U.S. application.

*Primary Examiner* — Haley A Smith
(74) *Attorney, Agent, or Firm* — Kolitch Romano Dascenzo Gates LLC

(57) ABSTRACT

A segmented sole for an article of footwear comprises a forefoot region, a heel region, and a segmentation zone disposed between the forefoot and heel region. The segmentation zone includes a plurality of segments separated from each other and from the forefoot and heel by a plurality of sipes, cuts, or gaps. The segmented sole produces bending along a segmentation axis disposed along an arch of a wearer
(Continued)

of an article of footwear including the sole, allowing for arch support and natural foot movement.

20 Claims, 13 Drawing Sheets

(51) Int. Cl.
*A43B 13/04* (2006.01)
*A43B 13/12* (2006.01)
*A43D 27/02* (2006.01)

(58) Field of Classification Search
USPC ..... D2/951, 959
See application file for complete search history.

(56) References Cited

U.S. PATENT DOCUMENTS 4,858,340 A * 8/1989 Pasternak ..... A43B 9/02 36/12
6,065,230 A * 5/2000 James ..... A43B 13/187 36/25 R
6,108,943 A * 8/2000 Hudson ..... A43C 1/04 36/31
7,555,851 B2 * 7/2009 Hazenberg ..... A43B 13/141 36/102
8,516,723 B2 * 8/2013 Ferrigan ..... A43B 3/0052 36/102
8,919,015 B2 * 12/2014 Holt ..... A43B 13/181 36/102
9,468,251 B2 10/2016 Auger
9,635,903 B2 5/2017 Lawless
9,668,542 B2 6/2017 Lawless
2007/0169379 A1 * 7/2007 Hazenberg ..... A43B 13/141 36/102
2008/0072457 A1 * 3/2008 Shakoor ..... A43B 13/141 36/102
2010/0269271 A1 * 10/2010 Kim ..... A43D 8/00 12/146 B
2011/0232133 A1 * 9/2011 Shakoor ..... A43B 13/141 36/102
2013/0232821 A1 * 9/2013 Schindler ..... A43B 13/181 36/103
2014/0223779 A1 * 8/2014 Elder ..... A43B 23/0245 36/83
2014/0259769 A1 * 9/2014 Bjornson ..... A43B 13/14 36/28
2014/0373396 A1 * 12/2014 Chang ..... A43B 13/141 36/30 R
2015/0135558 A1 * 5/2015 Inomata ..... A43B 13/14 36/25 R
2019/0053571 A1 * 2/2019 Bjornson ..... A43B 13/145
2021/0169172 A1 * 6/2021 Terasaki ..... A43B 13/141
2021/0251334 A1 * 8/2021 Tanabe ..... B29D 35/0036
2021/0330033 A1 * 10/2021 Pratt ..... A43B 13/141

* cited by examiner

SEGMENTED SOLE FOR FOOTWEAR

CROSS-REFERENCES

The following applications and materials are incorporated herein, in their entireties, for all purposes: U.S. Provisional Patent Application Ser. No. 62/894,653, filed Aug. 30, 2019

FIELD

This disclosure relates to systems and methods for footwear. More specifically, the disclosed embodiments relate to flexible footwear soles.

INTRODUCTION

Athletic shoes are generally designed to provide some level of support to a user's foot, while also allowing some level of free movement of the foot itself. Shoes may have various levels of flexibility and support based on an intended purpose of the shoe and user's preferences. Increasing shoe flexibility often decreases shoe supportiveness and vice versa. Shoe designers and manufacturers must balance these trade-offs to provide shoes which have preferred levels of flexibility and support.

Minimalist running shoes, for example, provide low levels of support to a wearer, are popular with runners and gym-goers who appreciate freedom of movement and a "barefoot" feeling while running. Minimalist running shoes may provide low levels of arch support and lightweight soles, allowing a wearer to experience greater contact with the ground. These shoes may provide adequate support for some runners, but may not provide adequate support for runners who are injury-prone or who consistently run on hard surfaces.

Minimalist shoes may be contrasted with conventional running shoes, which provide high levels of stability and support, preventing overpronation and absorbing shock associated with the foot striking the ground. However, conventional running shoes may be too heavy for some runners and may cause certain foot muscles to be underdeveloped. Conventional running shoes may also be unsuitable for gym workouts and other forms of exercise, which require greater flexibility along the arch of a wearer. Some athletes may appreciate the benefits of running or training shoes which provide flexibility while also providing arch support and shock absorption.

There is a need for shoes which accommodate anatomical movement within the feet of a wearer, while still preventing injuries which may be associated with rolled ankles or repeated shock from feet striking the ground.

SUMMARY

The present disclosure provides systems, apparatuses, and methods relating to segmented soles for footwear.

In some embodiments, a sole for an article of footwear may include a heel portion; a forefoot portion; and a segmentation zone disposed between the heel portion and the forefoot portion, the segmentation zone including a plurality of segments separated from each other by one or more sipes; wherein the segmentation zone is configured such that the sole compresses and expands as a function of compression and expansion within the sipes.

In some embodiments, an article of footwear may include an upper including a resilient sock liner; and a sole, the sole including: a heel portion; a forefoot portion; and a segmentation zone disposed between the heel portion and the forefoot portion, the segmentation zone including a plurality of segments separated from each other and from the heel and forefoot portions by a plurality of sipes; wherein the segmentation zone is configured such that a flexibility of the sole is at least partially a function of compression within the sipes.

In some embodiments, a method for manufacturing a sole for an article of footwear may comprise: forming a plurality of sipes in a bottom of a sole; wherein adding the plurality of sipes to the sole produces a segmentation zone, the segmentation zone including a plurality of segments; wherein the segments are separated from each other and from heel and forefoot portions of the sole by the plurality of sipes.

Features, functions, and advantages may be achieved independently in various embodiments of the present disclosure, or may be combined in yet other embodiments, further details of which can be seen with reference to the following description and drawings.

DETAILED DESCRIPTION

Figure 1:
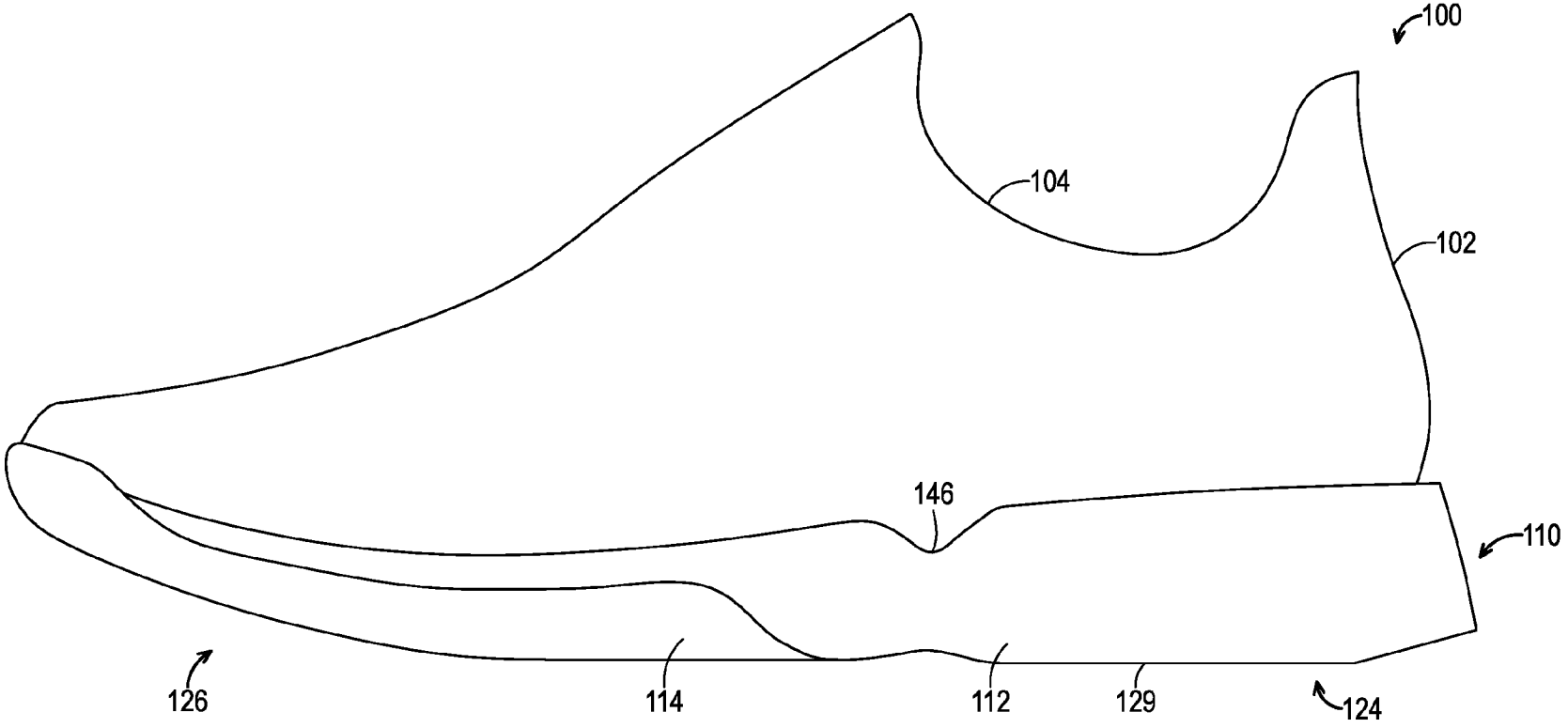
FIG. 1 is a left elevation view of a first illustrative article of footwear having a segmented sole.

Various aspects and examples of segmented soles for footwear, as well as related methods, are described below and illustrated in the associated drawings. Unless otherwise specified, an outsole in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

The terms "medial," "lateral," "anterior," "posterior," and the like are intended to refer to anatomical directions corresponding to a human on whom the article or object is configured to be placed or worn. For example, "medial" refers to a relative position disposed toward the center of the human body, while "lateral" refers to a relative position disposed away from the center of the human body. With respect to footwear, the term "anterior" refers to a relative position closer to the toe of a wearer and "posterior" refers to a relative position closer to the heel of the wearer. In the absence of a wearer, the same directional terms may be used as if the article of footwear is being worn in its expected configuration.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

"EVA" refers to ethylene-vinyl acetate.

"TPU" refers to thermoplastic polyurethane.

"PU" refers to polyurethane.

"TPE" refers to thermoplastic elastomer.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a sole for footwear in accordance with the present disclosure includes a heel portion, a forefoot portion, and a segmentation zone disposed between the heel and forefoot portions. The sole may be configured to be incorporated into an article of footwear, namely a shoe. In some examples, the sole includes a midsole coupled to an outsole such that the outsole is configured to be a ground-contacting surface of the sole and the midsole is configured to be coupled to bottom surfaces of a shoe upper, such as a Strobel board, sockliner, and/or the like. The segmentation zone may include one or more segments or wings, which are separated from each other and from the heel and forefoot portions by a plurality of sipes, cuts, or gaps extending transverse to a longitudinal axis of the shoe.

The sipes radiate outward from a common origin or originating area disposed along an arch of the sole toward a medial edge of the sole. The common origin (AKA connection point) are disposed on a lateral side of the longitudinal axis. In some examples, the common origin is disposed at a lateral edge of the sole. In some examples, the common origin is disposed slightly interior to the lateral edge and may be separated from the lateral edge by a separation distance. In some examples, the sole includes a notch disposed between the lateral edge and the common origin, which may add additional flexibility to the segmentation zone.

The sipes are oriented generally transverse to the length of the sole, and are configured such that the sole is segmented generally orthogonally with respect to a direction of travel. The sipes are configured such that the orthogonal segmentation is disposed in a position roughly corresponding to the arch of the wearer. This configuration of sipes enables bending (i.e., compression and tension) along an area of the sole that is medial to the longitudinal axis of the sole, such that the forefoot and heel of the sole can move in a lateral direction (i.e., sideways) in response to corresponding movement of the human foot.

The sole includes at least two sipes, each adjacent pair of which may collectively define outer edges of a respective wing-shaped segment extending from the common origin to the medial edge of the sole. In some examples, the sole includes at least three sipes, which define two segments extending from the connection point to the medial edge of the sole. In some examples, the sipes are tapered and substantially triangular, with a sipe width being greater at the medial edge of the sole than at the common origin, facilitating compression in the gaps between the segments and along the longitudinal axis of the shoe.

In some examples, the segments are substantially pyramidal from medial to lateral edge, having a roughly square base disposed along the medial edge of the sole. Ground-contacting surfaces and top surfaces of the segments may be triangular, and the segments may slope upward from the common origin to the medial edge, providing arch support along top surfaces of the segments. This configuration of sipes facilitates the prevention of overpronation while providing increased flexibility when compared with non-segmented soles.

In general, an article of footwear or shoe including a sole according to the present disclosure includes an upper bonded to a sole and a flexible insole disposed above the sole and inside an interior region of the article of footwear. In some embodiments, the upper is Strobel-lasted and the flexible insole is sewn to a lower edge of the upper, forming the interior region of the shoe. The sole may then be bonded to bottom surfaces of the upper-insole assembly (e.g., a Strobel board).

In general, an illustrative method of manufacture for a segmented sole for an article of footwear may include providing a sole, wherein the sole includes a midsole and an outsole, and segmenting the sole to produce a plurality of segments separated by sipes.

EXAMPLES, COMPONENTS, AND ALTERNATIVES

The following sections describe selected aspects of exemplary segmented footwear soles as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Articles of Footwear

As shown in FIGS. 1-12, this section describes illustrative articles of footwear including segmented soles.

Figure 2:
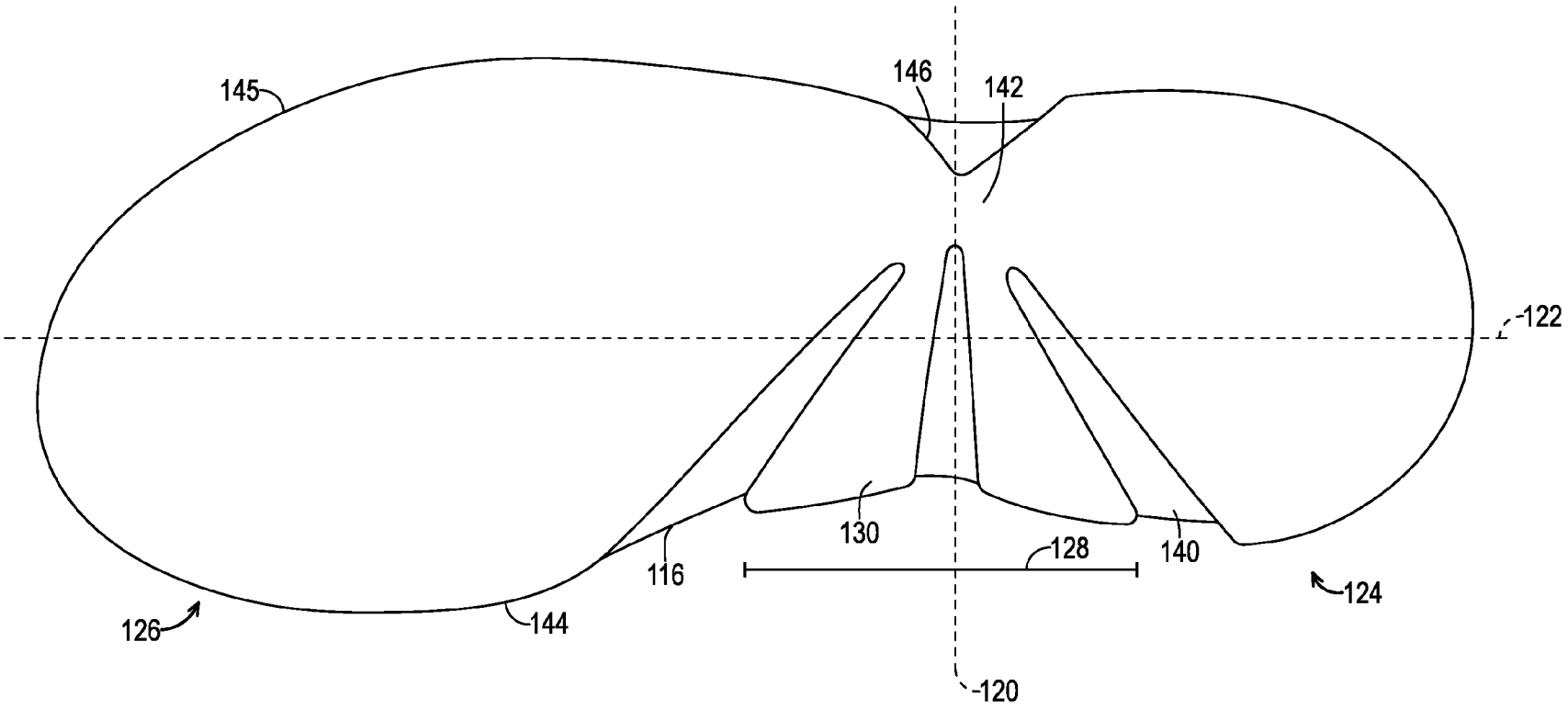
FIG. 2 is a bottom plan view of the illustrative article of footwear of FIG. 1.

As depicted in FIGS. 1 and 2, a first article of footwear or shoe 100 including a segmented sole includes an upper 102 coupled to a sole 110. Sole 110 includes an outsole 114 coupled (e.g., bonded) to a bottom surface of a midsole 112. A flexible sockliner or insole 116 is disposed on a top surface of the midsole, or on a top surface of a Strobel board forming a bottom surface of the upper. The shoe may be Strobel lasted (AKA slip, force, or California lasting), wherein a Strobel board is sewn, glued, or otherwise attached to the upper such that the Strobel board forms a bottom surface of an interior region of the shoe. In some examples, the Strobel board comprises sockliner 116. Upper 102 includes a foot opening 104 disposed at a top anterior surface of the upper. In some embodiments, the upper of the shoe is laced, and includes a shoelace and tongue.

Upper 102 may include any suitable textile or combination of textiles typically used in shoe manufacture, such as a resilient or elastic material (e.g., nylon, lycra, polyester, polyurethane, and/or the like). In some examples, the sockliner 116 comprises polyurethane, ethylene-vinyl acetate (EVA), and/or another resilient polymer allowing for support and flexibility in the sole of a wearer's foot. In some examples, the sockliner 116 comprises nylon, lycra, and/or the like. The shoe may be configured to allow the arch of a wearer of the shoe to flatten along a longitudinal axis of the shoe. Upper and/or sockliner materials may be selected to stretch and flatten with the foot such that the arch of the wearer can flatten as the foot moves.

In some examples, a supplemental insole 118 (see FIG. 12) is disposed above integrated sockliner 116 and inside the interior of the shoe, and may provide additional cushioning and support to a foot of the wearer. In some examples, the sockliner and/or supplemental insole of the shoe includes reinforcements to provide additional arch support for a wearer of the shoe, such as resilient polymer inserts, areas of increased thickness around the arch of the shoe, and/or added plates and/or shanks to reduce flexibility.

In some examples, supplemental insole 118 includes segmentation similar to the sole segmentation described above. (See FIG. 12) Supplemental insole 118 includes one or more sipes 119 disposed transverse to a length of the sole. In some examples, sipes 119 extend from a lateral edge of the insole toward a medial edge of the insole. In some examples, the upper is reinforced with polymers such as polyurethane, EVA, polyester, and/or other polymers configured to resist loads applied by a wearer's weight. The reinforcements may be applied to areas of the upper corresponding to shoelace or segment attachment points.

With reference to FIG. 2, sole 110 is segmented around a segmentation axis 120 disposed generally orthogonal to a longitudinal axis 122 of the shoe. The sole includes a heel portion 124, a forefoot portion 126, and a segmentation zone 128 disposed between the heel and forefoot of the shoe. The segmentation zone includes one or more segments 130, which are separated from each other and from the heel and forefoot portions by a plurality of grooves, cuts, gaps, or sipes 140 extending transverse to the longitudinal axis 122 of the shoe. In some examples, segments 130 may be substantially triangular. In some examples, the sole includes a minimum of three sipes and two wing segments, facilitating a distribution of pressure from the weight of a wearer along the segmentation zone.

The number of sipes 140 and wing segments 130 may differ based on one or more functional variables. A sole including a greater number of sipes may be more flexible, while a sole including fewer sipes may be stiffer or more rigid. Thicker midsoles may also utilize a greater number of sipes when compared with thinner midsoles to achieve an approximately equivalent level of sole flexibility. More rigid sole materials may utilize a greater number of sipes when compared with more elastic sole materials to achieve a comparable level of flexibility. Soles may include a greater number of sipes to distribute bending force along a larger region of the shoe, e.g., to increase shoe durability. Soles designed for shoes of larger sizes may include more sipes than smaller shoes.

Sipes 140 radiate outward from a common region 142, disposed along an arch of the sole, toward a medial edge 144 of the sole. In this example, common region 142 is disposed on a lateral side of the longitudinal axis 122. In some examples, a notch 146 in the sole is disposed at a lateral edge 145 near common region 142. This configuration facilitates increased flexibility within the segmentation zone.

Sipes 140 may have any suitable widths. Shoes including wider sipes may be more flexible than shoes including narrower sipes, as the sipes act as compression and expansion zones for the shoe. Sipes may also have varying lengths, with shorter sipes providing greater flexibility across the medial side of the arch, and longer sipes providing flexibility along more of a width of the foot. Shoes may include sipes of varying widths and lengths within a single sole. For example, sipes disposed closer to segmentation axis 120 may be shorter than sipes disposed closer to heel and forefoot regions of the shoe.

Sole 110 has a ground-contacting surface 129, which at heel portion 124 may be substantially flat, allowing for stability while a wearer is standing, and which at forefoot portion 126 may be rounded or tapered, facilitating a rolling movement through the foot while walking or running. The sole may be configured to facilitate a complete rolling through the foot by the wearer, as a function of the increased flexibility of the sole in the segmentation zone.

Figure 3:
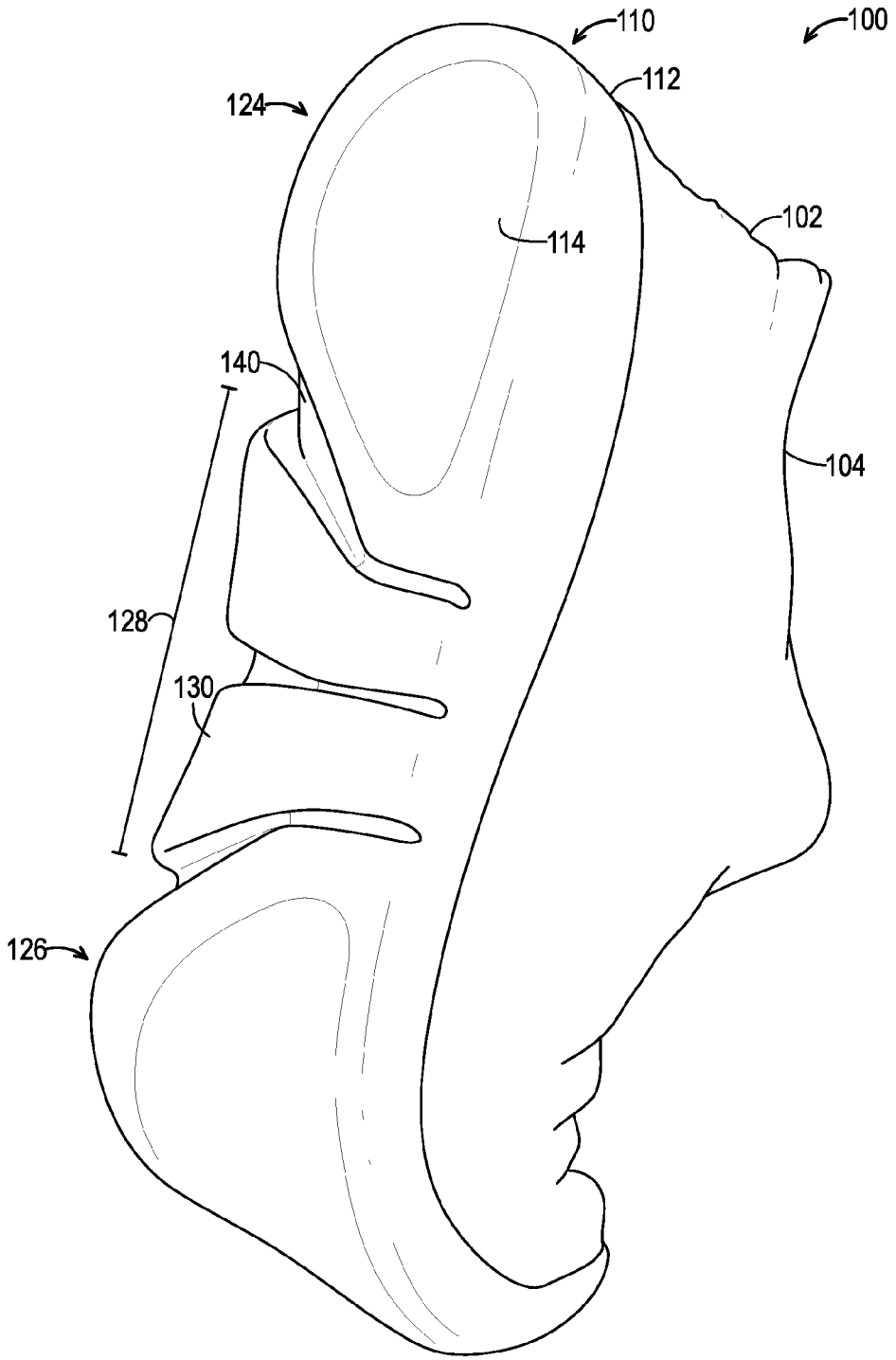
FIG. 3 is an isometric view of an illustrative article of footwear in a flexed position.

FIG. 3 depicts a bending of the sole in normal use. Rolling through the foot flexes the sole throughout segmentation zone 128, increasing a length of the shoe as a length of the wearer's arch increases.

Figure 4:
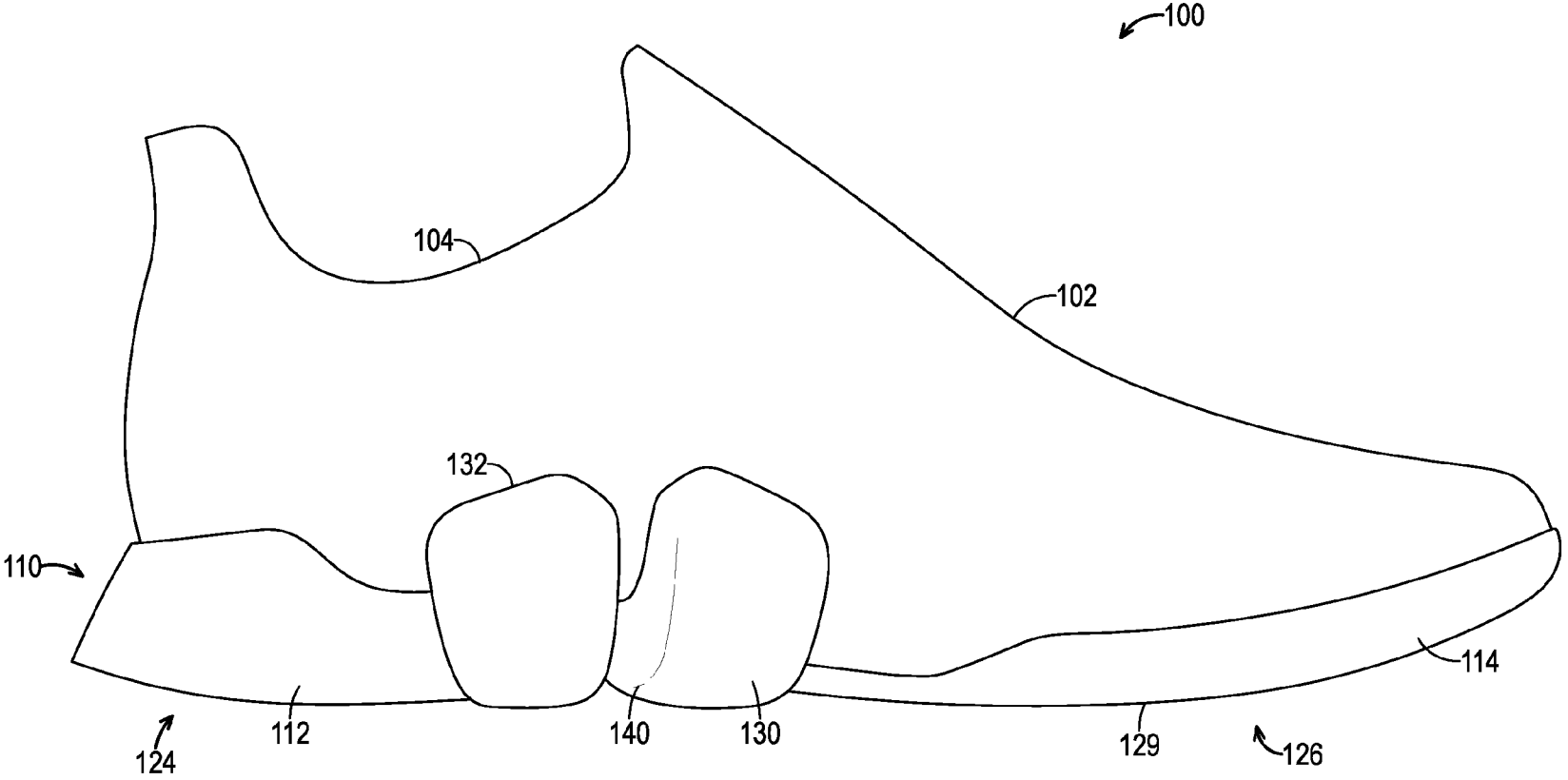
FIG. 4 is a right elevation view of the illustrative article of footwear of FIG. 1.

FIG. 4 depicts a side view of segments 130 included within the article of footwear. The segments are separated from each other and from the forefoot and heel portion by sipes 140, which define outer edges of the segments. In some examples, the segments taper from the lateral edge of the shoe to the medial edge of the shoe, with a triangular profile when viewed from below and a substantially square profile when viewed from the medial side of the shoe. In some examples, segments 130 are substantially pyramidal. Segments 130 are configured to support the arch of a wearer of the shoe, and may include a curved top surface 132. Segments 130 can have different sizes and profiles without departing from the scope of the invention.

In some examples, segmented sole 110 is coupled to upper 102 of shoe 100 using adhesive, sewing, and/or other suitable attachment methods, e.g., a single-use fastener. In some examples, segmented sole 110 is coupled to a bottom surface of sockliner 116 using adhesive. In some examples, forefoot and heel regions of sole 110 are coupled to upper 102 using a first attachment method (e.g., adhesive, sewing, etc.) and segments 130 are coupled to upper 102 using a second attachment method (e.g., adhesive, sewing, etc.). In some examples, the wing segments are coupled to the laces of the shoe, which pull upward on the wing segments when tied, thereby providing greater arch support to a wearer of the shoe. In some examples, the wing segments wrap at least partially around the upper of the shoe, and therefore the user's foot, improving shoe durability and providing increased arch support.

In some implementations, midsole 112 includes two or more midsole layers (e.g., in a dual configuration comprising an external midsole facing the outsole 114, and an internal midsole facing the insole 116). In some examples midsole 112 includes an internal midsole disposed proximate an interior of the shoe and an external midsole disposed proximate ground-contacting surface 129, 129A. In some examples, such as when a Strobel board of the shoe comprises sockliner 116, the Strobel board can be positioned between the external midsole and the external midsole. In some examples, the internal midsole can be disposed within a "sock" of the shoe comprising upper 102 and sockliner 116, which is configured to contain the foot of a wearer. In some examples, sipes 140 are formed only in the external midsole. In other examples, the sipes are formed in the external midsole and at least part of the internal midsole.

Figure 5:
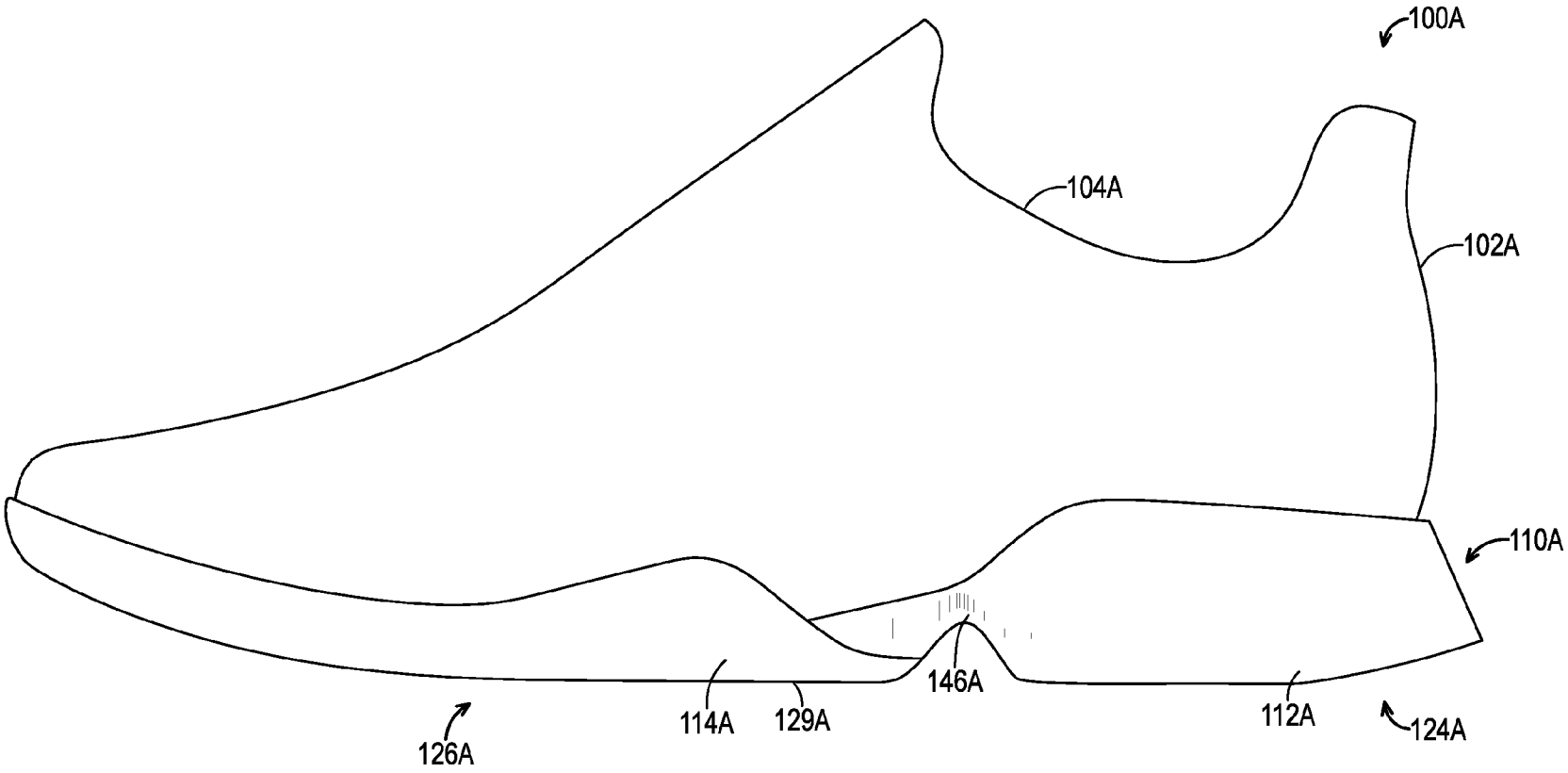
FIG. 5 is a left elevation view of an illustrative article of footwear having a segmented sole and a first outsole material ratio.
Figure 6:
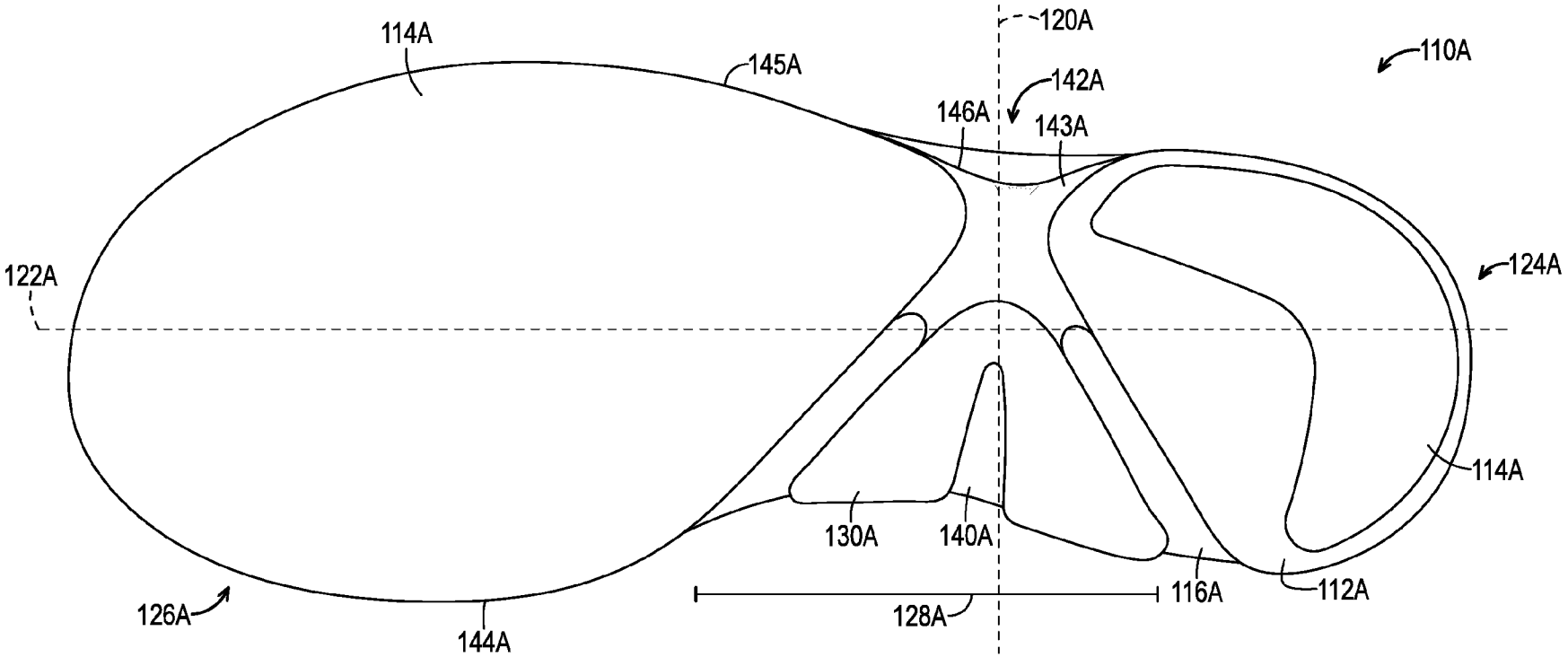
FIG. 6 is a bottom plan view of the illustrative article of footwear of FIG. 5.

FIGS. 5-8 depict a variety of illustrative midsole-outsole configurations. Different midsole-outsole configurations result in shoes having varying levels of flexibility, traction, and/or durability. FIGS. 5-6 depict a shoe 100A including an upper 102A having a foot opening 104A disposed at a top anterior surface of the upper. Shoe 100A is substantially similar to shoe 100, except as described below. Sole 110A includes an outsole 114A coupled (e.g., bonded) to a bottom surface of a midsole 112A. A flexible sockliner or insole 116A is disposed on a top surface of the midsole, or on a top surface of a Strobel board forming a bottom surface of the upper. As described above, sole 110A is segmented around a segmentation axis 120A disposed generally orthogonal to a longitudinal axis 122A of the shoe. Sole 110A has an outsole 114A which covers a majority of a ground-contacting surface 129A of the shoe. While outsole 114A does not contact wings or sipes of segmentation zone 128A, the sole depicted in FIGS. 5-6 may have decreased flexibility when compared with the sole depicted in FIGS. 7-8.

Figure 7:
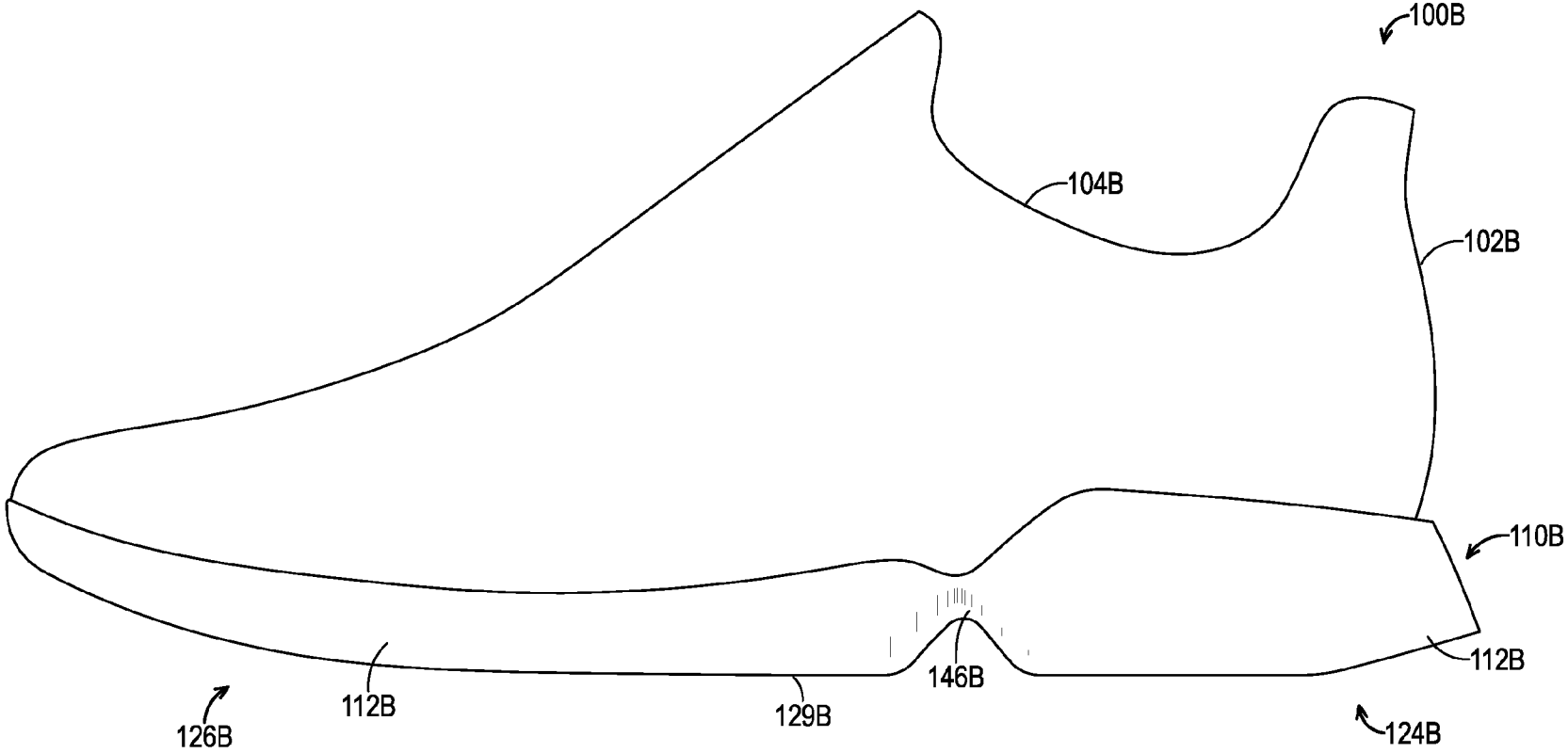
FIG. 7 is a left elevation view of an illustrative article of footwear having a second outsole material ratio.
Figure 8:
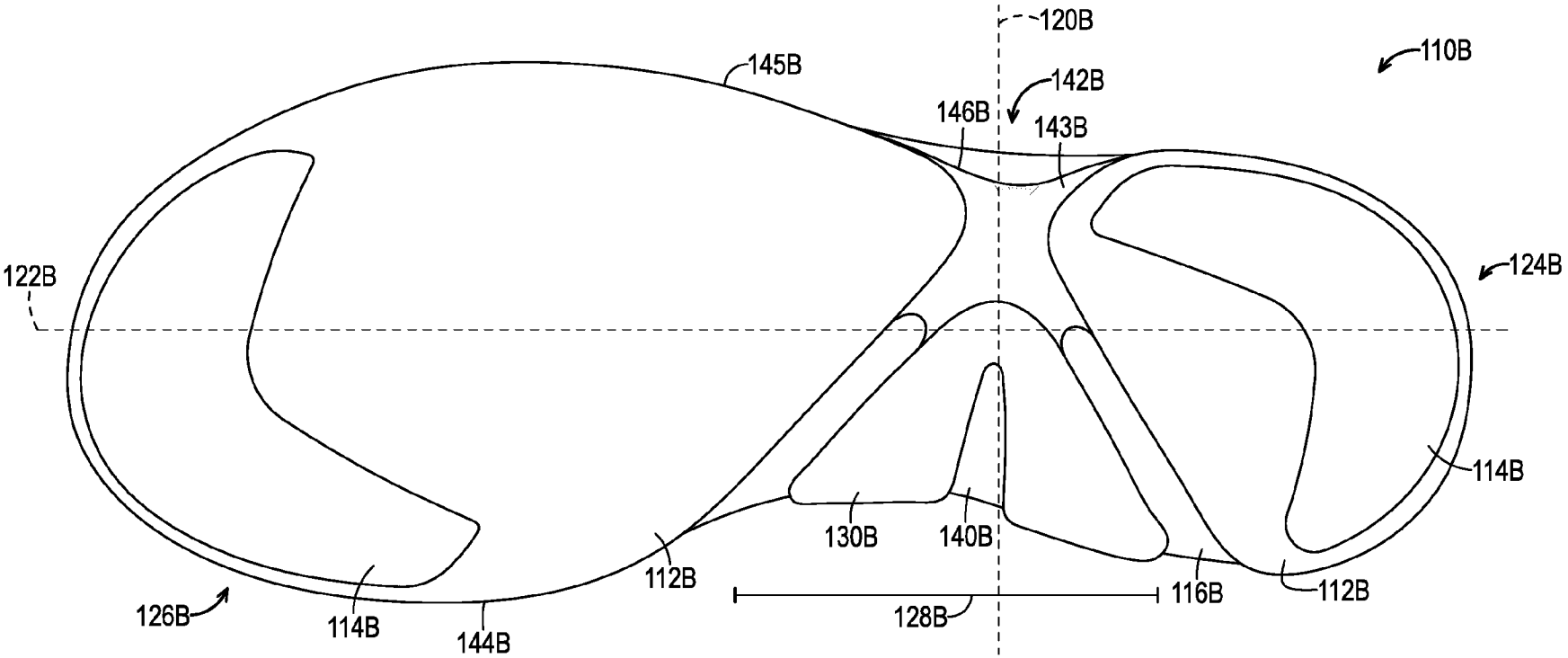
FIG. 8 is a bottom plan view of the illustrative article of footwear of FIG. 7.

FIGS. 7-8 depict a shoe 100B including an upper 102B having a foot opening 104B disposed at a top anterior surface of the upper. Shoe 100B is substantially similar to shoe 100, except as described below. Sole 1106 includes an outsole 114B coupled (e.g., bonded) to a bottom surface of a midsole 112B. A flexible sockliner or insole 116B is disposed on a top surface of the midsole, or on a top surface of a Strobel board forming a bottom surface of the upper. As described above, sole 1106 is segmented around a segmentation axis 120B disposed generally orthogonal to a longitudinal axis 122B of the shoe. Sole 1106 having a more minimal outsole 114B, with the outsole only covering areas of the sole which require greater amounts of grip. Portions of midsole 112B may form portions of a ground-contacting surface 129B of the sole. Flexibility of sole 1106 within a segmentation zone 128B may be similar to flexibility of sole 110A within segmentation zone 128A. However, sole 1106 may have increased flexibility within a heel region and forefoot region 1246, 1266 when compared with sole 110A due to more flexible midsole materials.

Midsoles 112A, 112B may comprise lightweight materials configured to cushion the sole, such as EVA, polyurethane, TPU, and/or other force-absorbent polymers. Outsoles 114A, 114B may comprise any suitable durable, resilient materials configured to provide grip and durability, such as rubber and/or the like. Sole materials may be selected based on a variety of material properties, such as flexibility, durability, weight, and/or other factors affecting shoe performance. The midsole and/or outsole include a tread pattern configured to increase sole traction on underlying surfaces. As typical midsole materials are more lightweight than typical outsole materials, the sole depicted in FIGS. 7-8 may have increased flexibility when compared with the sole depicted in FIGS. 5-6.

The soles depicted in FIGS. 5-8 include an illustrative common region 142A, 142B for use in sole 110A, 110B. Common region 142A, 142B is recessed when compared with heel region 124A, 124B and forefoot portion 126A, 126B. As described above, common region 142A, 142B may include a notch or gap 146A, 146B disposed at a lateral edge 145A, 145B, which may increase flexibility within the common region. Segments 130A, 130B extend from bottom surfaces (when in use) of common region 142A, 142B, toward a medial edge 144A, 144B of the sole, and have an increased thickness when compared with the common region. In some examples, ground-contacting surfaces of segments 130A, 130B are substantially coplanar with ground-contacting surfaces of the heel and forefoot regions. This configuration may further increase flexibility of the sole, as recess 143A, 143B below common region 142A, 142B may function similarly to sipes 140A, 140B when the shoe is in use, compressing and extending along longitudinal axis 122A, 122B.

Figure 9:
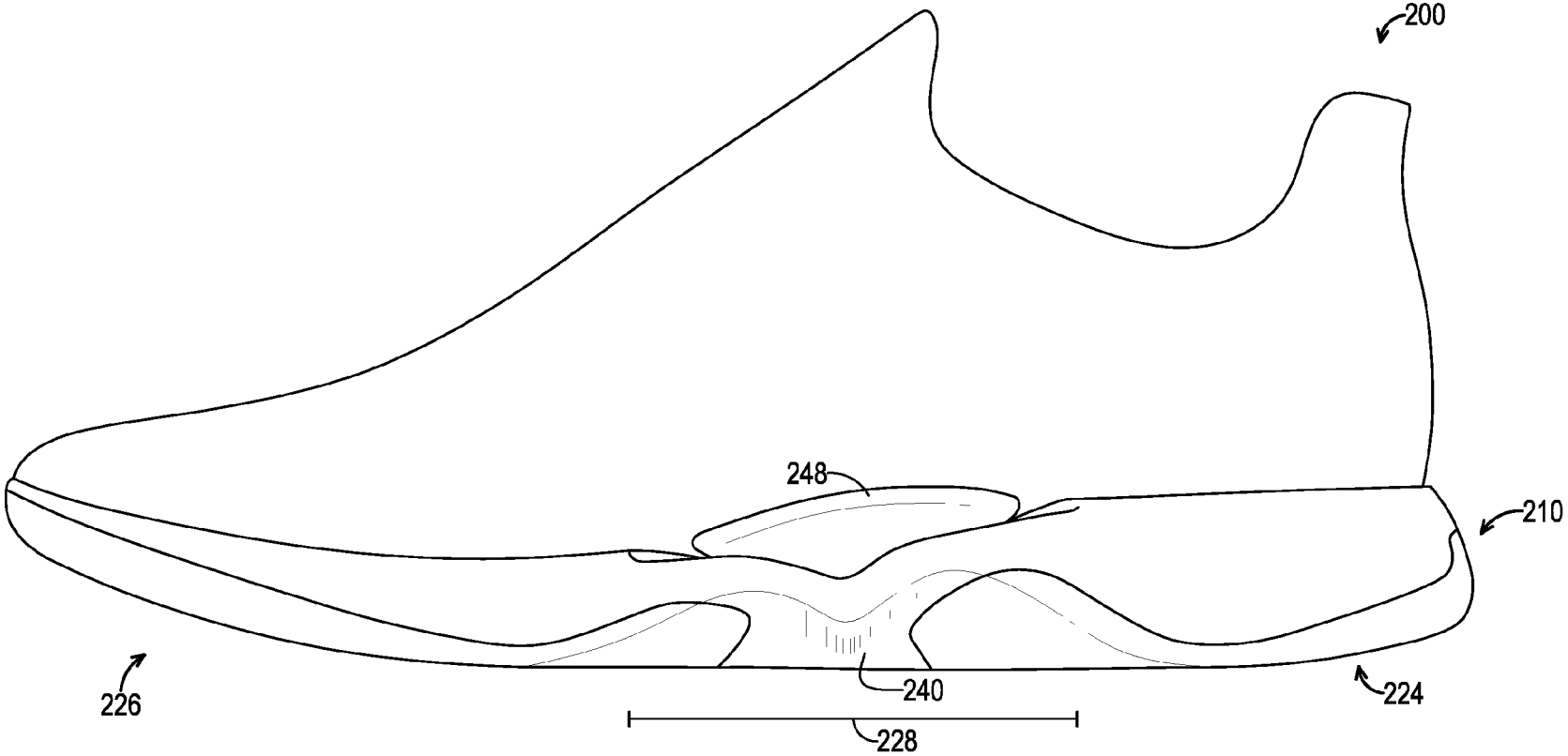
FIG. 9 is a right elevation view of a second illustrative article of footwear having a segmented and flexible sole.
Figure 10:
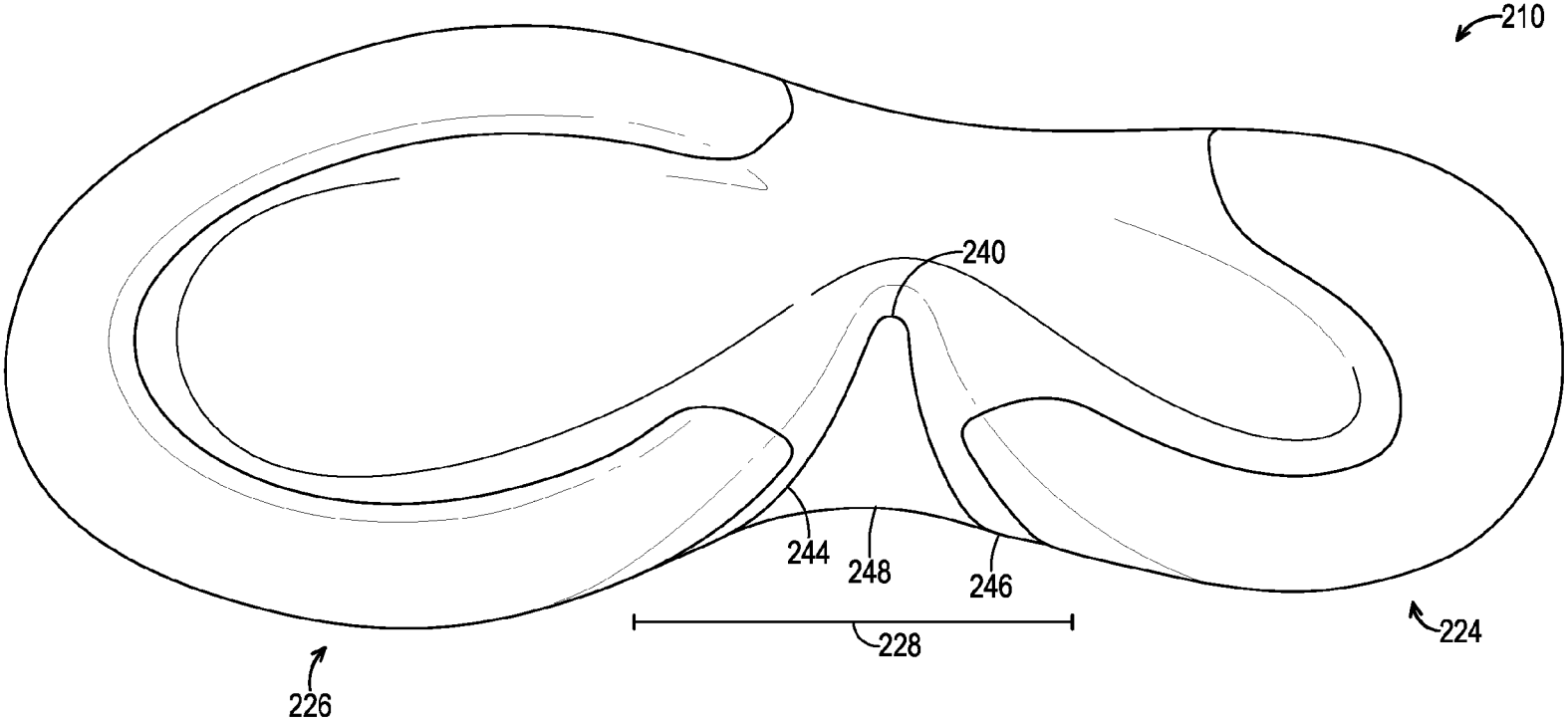
FIG. 10 is a bottom plan view of the second illustrative article of footwear of FIG. 9.
Figure 11:
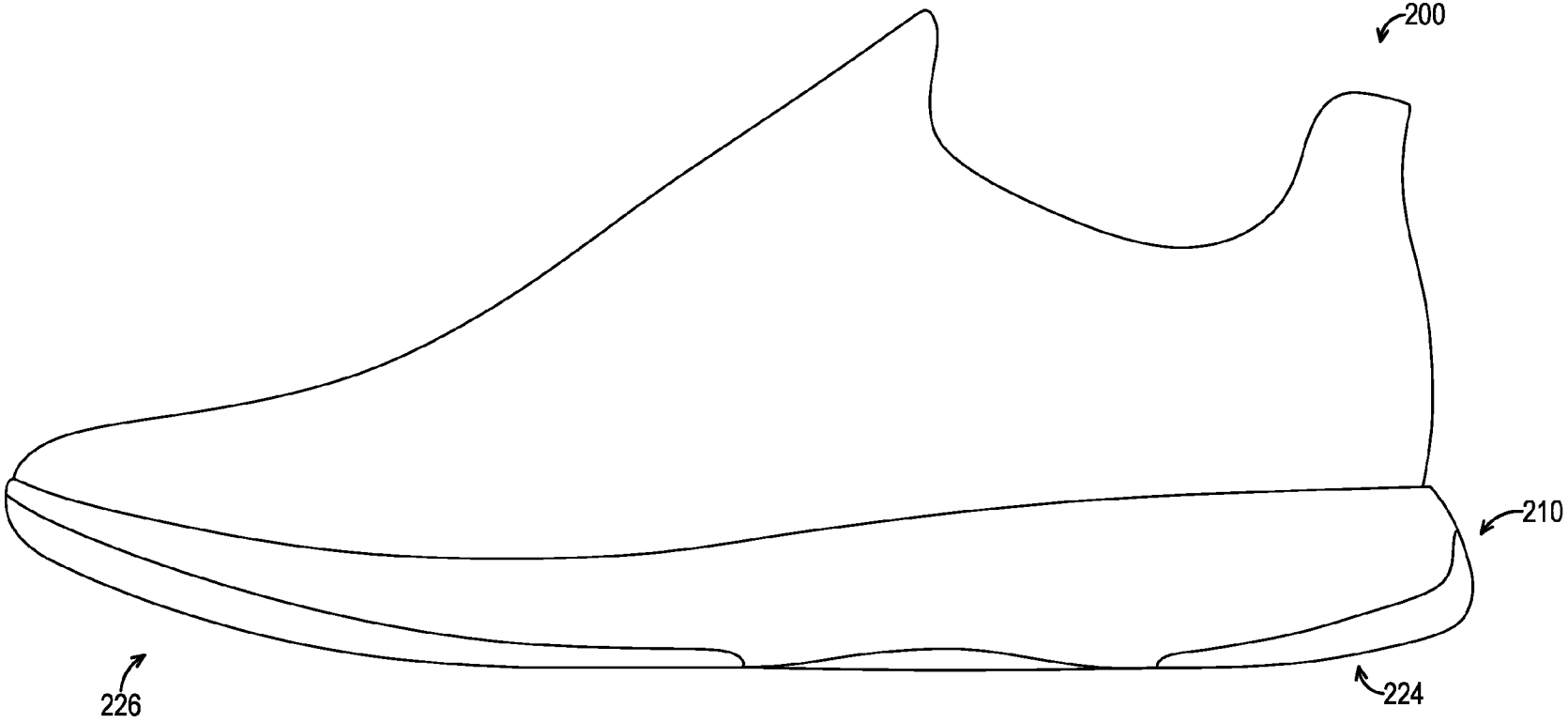
FIG. 11 is a left elevation view of the second illustrative article of footwear of FIG. 9.
Figure 12:
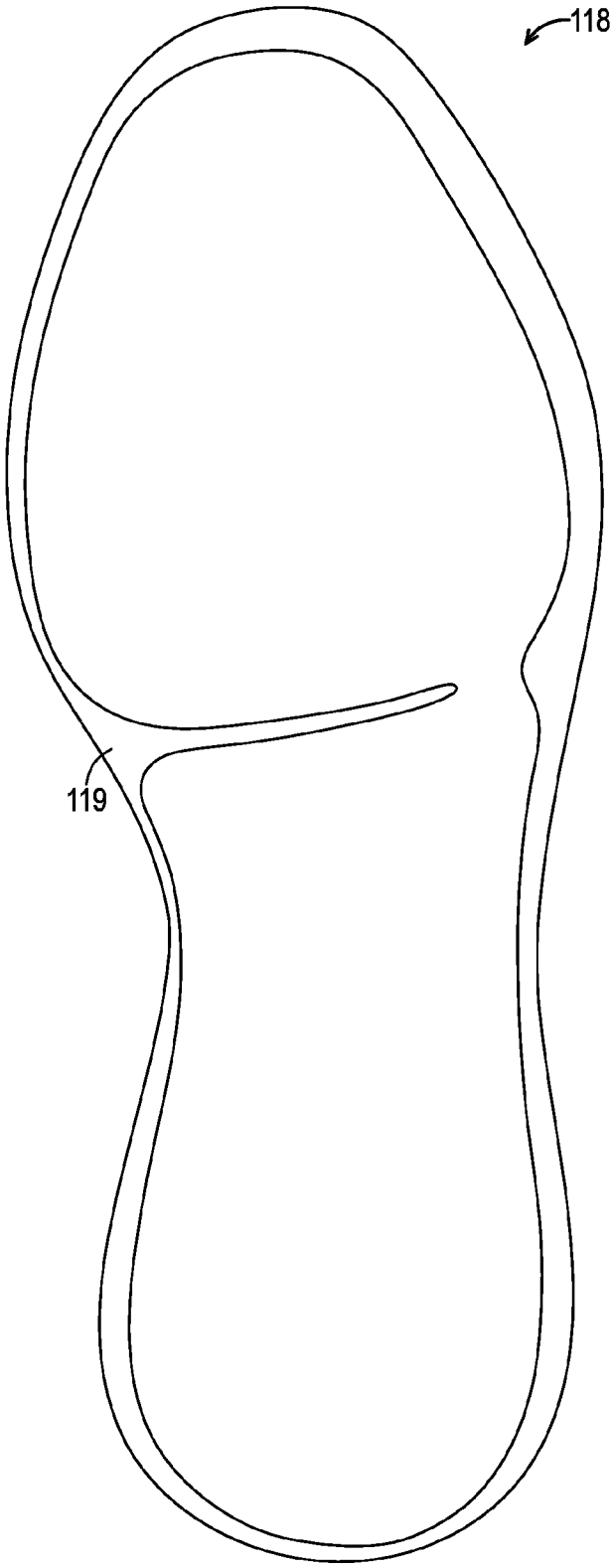
FIG. 12 is a bottom plan view of an illustrative segmented insole suitable for use within the illustrative articles of footwear depicted in FIGS. 1-9.

FIGS. 9-11 depict a shoe 200 having a segmented sole 210, including a forefoot portion 226, a heel portion 224, and a segmentation zone 228 disposed between the forefoot portion and the heel portion. Segmentation zone 228 includes a single notch or gap 240 between the forefoot portion and the heel portion, with a forefoot edge 244 and a heel edge 246 extending radially outward from a common region 242 disposed along an area of the sole corresponding to an arch of a wearer's foot. An elastic material may extend between the forefoot edge and heel edge, providing a support component 248 for the arch of the wearer. The shoe may otherwise be substantially identical to the shoe described above with respect to FIGS. 1-8.

The following reference numerals are utilized in the accompanying drawings:

100, 100A, 100B shoe
102, 102A, 102B upper
104, 104A, 104B foot opening
110, 110A, 1106 sole
112, 112A, 112B midsole
114, 114A, 114B outsole
116, 116A, 116B sockliner
118 supplemental insole
119 insole sipes
120, 120A, 120B segmentation axis
122, 122A, 122B longitudinal axis
124, 124A, 124B heel portion
126, 126A, 126B forefoot portion
128, 128A, 128B segmentation zone
129, 129A ground-contacting surface
130, 130A, 130B segments
132 curved top surface
140, 140A, 140B sipes
142, 142A, 142B common region
143A, 143B recess
144, 144A, 144B medial edge
145, 145A, 145B lateral edge
146, 146A, 146B notch
200 shoe
210 segmented sole
224 heel portion
226 forefoot portion
228 segmentation zone
240 notch or gap
242 common region
244 forefoot edge
246 heel edge
248 support component

B. Illustrative Method of Manufacture

This section describes steps of an illustrative method 1000 for manufacturing segmented footwear soles. Aspects of illustrative articles of footwear and illustrative soles, described above, may be utilized in the method steps described below. Where appropriate, reference may be made to components and systems that may be used in carrying out each step. These references are for illustration, and are not intended to limit the possible ways of carrying out any particular step of the method.

Figure 13:
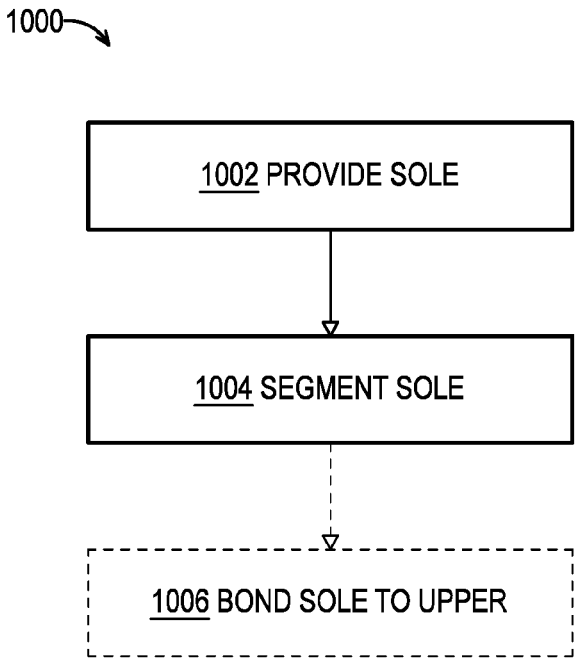
FIG. 13 is a flowchart depicting steps of an illustrative method for manufacturing a segmented sole for an article of footwear in accordance with aspects of the present disclosure.

FIG. 13 is a flowchart illustrating steps performed in an illustrative method, and may not recite the complete process or all steps of the method. Although various steps of method 1000 are described below and depicted in FIG. 13, the steps need not necessarily all be performed, and in some cases may be performed simultaneously or in a different order than the order shown.

Step 1002 of method 1000 includes providing a sole for an article of footwear (e.g., an athletic shoe), the sole including a midsole coupled to an outsole. In some embodiments, providing a sole includes procuring a premanufactured sole from another party. In some examples, providing a sole includes manufacturing a sole for an athletic shoe using thermoforming, injection molding, 3D printing, and/or any suitable method for producing a foam or polymer sole for an athletic shoe. In some examples, providing a sole includes providing a premanufactured midsole and a premanufactured outsole and subsequently bonding the midsole and outsole using adhesive, mechanical attachment methods, and/or other suitable methods for bonding two sole components. In some examples, the midsole and/or outsole may comprise any of a variety of polymers, including EVA, PU, TPU, Nylon, rubber, TPE, and/or any other suitable polymer for producing footwear soles. In some examples, the midsole may comprise PU, EVA, TPU, nylon, and/or any other polymer with cushioning or energy returning properties. In some examples, the outsole may comprise durable polymers such as rubber, TPE, and/or any other polymer with advantageous grip and wear properties.

Step 1004 includes segmenting the sole by cutting or otherwise creating sipes. In some examples, each sipe may include a single cut disposed transverse to a longitudinal axis of the sole. In some examples, each sipe may include two cuts disposed transverse to the longitudinal axis, such that the sipes are tapered, e.g., widest at a medial edge of the shoe and decreasing in width as they extend toward a lateral side of the shoe.

In examples where the sipes are cut into the sole (e.g., rather than being molded), cutting sipes into the sole may comprise any suitable method for cutting a preformed polymer or foam component. For example, this may include die cutting, laser cutting, cutting with a water jet cutter, and/or any other suitable method for cutting shapes from a prefabricated polymer component. Cutting the sipes may be done by hand or may be done using CNC (computer numeric control) or other forms of automated cutting.

In some examples, steps 1002 and 1004 are performed simultaneously. In these examples, thermoforming or injection molding the sole may include providing a mold including premanufactured sipe-forming regions. These regions may comprise appendages, castellations, and/or other protrusions included within a mold which prevent deposition of material in certain areas, producing sipes or gaps or cuts within the sole.

Step 1004 may optionally be followed by step 1006, which includes coupling the completed sole to a pre-manufactured upper to produce a completed shoe or other article of footwear. The completed sole may be fastened by bonding to the pre-manufactured upper using adhesive and/or other suitable mechanical attachment methods.

C. Illustrative Method of Use

An illustrative method of use for an article of footwear or shoe including a segmented sole includes flexing the sole along a direction of anatomical movement in a foot wearing the shoe. This direction of anatomical movement corresponds to a longitudinal axis of the shoe, extending between the forefoot portion of the shoe and the heel of the shoe. Flexing the sole in a first direction, such that the heel and forefoot are caused to move toward the top of the shoe, causes the sipes to expand in width, lengthening the shoe. The upper stretches with the sole, and the arch of a wearer stretches with the sole. Flexing the sole in a second direction, such that the heel and forefoot are moved toward the bottom of the shoe, causes the sipes to compress in width, contracting the shoe. This may be useful for dance applications or other activities such as hiking or trail running which require a high degree of maneuverability. Applying uniform downward pressure across the shoe, such as when standing, also causes the arch of a wearer to flatten, as the (e.g., elastic) upper facilitates a stretching of the foot along a longitudinal axis.

D. Illustrative Combinations and Additional Examples

This section describes additional aspects and features of segmented footwear soles, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A sole for an article of footwear, comprising: a heel portion; a forefoot portion; and a segmentation zone disposed between the heel portion and the forefoot portion, the segmentation zone including a plurality of segments separated from each other by one or more sipes; wherein the segmentation zone is configured such that the sole compresses and expands as a function of compression and expansion within the sipes.

A1. The sole of paragraph A0, wherein the plurality of sipes includes at least three sipes.

A2. The sole of any one of paragraphs A0-A1, wherein each of the plurality of segments is substantially triangular in shape.

A3. The sole of any one of paragraphs A0-A2, wherein the sole comprises a midsole and an outsole.

A4. The sole of paragraph A2, wherein the midsole comprises polyurethane.

A5. The sole of any one of paragraphs A3-A4, wherein the outsole comprises rubber.

B0. An article of footwear, comprising: an upper including a resilient sockliner; and a sole, the sole including: a heel portion; a forefoot portion; and a segmentation zone disposed between the heel portion and the forefoot portion, the segmentation zone including a plurality of segments separated from each other and from the heel and forefoot portions by a plurality of sipes; wherein the segmentation zone is configured such that the sole is bendable as a function of compression within the sipes.

B1. The article of footwear of paragraph B0, wherein the plurality of sipes includes at least three sipes.

B2. The article of footwear of any one of paragraphs B0-B1, wherein each wing of the plurality of segments is substantially triangular in shape.

B3. The article of footwear of any one of paragraphs B0-B2, wherein the sole comprises a midsole and an outsole.

B4. The article of footwear of paragraph B2, wherein the midsole comprises polyurethane.

B5. The article of footwear of any one of paragraphs B3-B4, wherein the outsole comprises rubber.

B6. The article of footwear of any one of paragraphs B0-B5, wherein the upper comprises nylon.

B7. The article of footwear of any one of paragraphs B0-B6, wherein the midsole is bonded to the upper using adhesive.

B8. The article of footwear of any one of paragraphs B0-B7, wherein the article of footwear comprises a shoelace.

B9. The article of footwear of paragraph B8, wherein each segment of the plurality of segments is coupled to the upper by the shoelace.

C0. A method for manufacturing a sole for an article of footwear, comprising: providing a sole; and adding a plurality of sipes to the provided sole; wherein adding sipes to the provided sole produces a segmentation zone, the segmentation zone including a plurality of segments, wherein the segments are separated from each other and from the heel and forefoot portions by the plurality of sipes.

C1. The method of paragraph C0, wherein adding the plurality of sipes to the provided sole includes die cutting.

C2. The method of paragraph C0, wherein adding the plurality of sipes to the provided sole includes injection molding.

C3. The method of paragraphs C0-C2, wherein the plurality of sipes includes at least three sipes.

D0. The construction of a shoe wherein the midsole and outsole are segmented and/or split along an orthogonal axis to a perpendicular vector in which anatomical movement would occur on the human foot.

D1. This segmentation can be accomplished via, but is not limited to: breaking, material combinations, filler materials with engineered elastic modulus, top-down gapping, and bottom-up gapping.

D2. The segmentation along given axis is such that a moment arm correspondent to the axial break or opposite the midsole, outsole, or a combination of the two, allows for both a tension and compression force that aligns with movement of the human foot.

E0. A product comprising any feature described herein, either individually or in combination with any other such feature, in any configuration.

F0. A process for manufacturing a sole for an article of footwear, the process comprising any process step described herein, in any order, using any modality.

Advantages, Features, and Benefits

The different embodiments and examples of the segmented footwear sole described herein provide several advantages over known solutions for providing flexible, but supportive shoe soles. For example, illustrative embodiments and examples described herein allow a wearer of the shoe to experience shoe bending which allows their foot to move in a natural anatomical motion.

Additionally, and among other benefits, the footwear sole described herein allows the arch of a wearer to flatten during use.

Additionally, and among other benefits, the footwear sole described herein supports the arch of a wearer.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A sole for an article of footwear, the sole comprising:
a heel portion;
a forefoot portion; and
a segmentation zone disposed between the heel portion and the forefoot portion, the segmentation zone including a plurality of wing segments separated from each other by one or more sipes, wherein the one or more sipes radiate outward from a common origin disposed on a lateral side of the longitudinal axis of the sole toward a medial edge of the sole, and wherein, in the common origin, the one or more of sipes do not fully surround the plurality of wing segments, defining regions of attachment between the plurality of wing segments, the heel portion, and the forefoot portion of the sole;
wherein the common origin is disposed along an arch of the sole; and
wherein the segmentation zone is configured such that the sole compresses and expands as a function of compression and expansion within the one or more sipes.

2. The sole of claim 1, wherein one or more sipes includes at least three sipes.

3. The sole of claim 1, further comprising a notch disposed at a lateral edge of the sole near the common origin.

4. The sole of claim 3, wherein at least one segment of the plurality of segments is tapered such that a medial end is wider than a lateral end in two dimensions.

5. The sole of claim 1, wherein the sole comprises a midsole and an outsole.

6. The sole of claim 5, wherein the midsole comprises polyurethane.

7. The sole of claim 5, wherein the outsole comprises rubber.

8. A sole for an article of footwear, the sole comprising:
a heel portion;
a forefoot portion;
and a segmentation zone disposed between the heel portion and the forefoot portion, the segmentation zone including a plurality of segments separated from each other and from the heel and forefoot portions by a plurality of sipes extending transverse to a longitudinal axis of the sole, wherein the plurality of sipes radiate outward from a common origin disposed on a lateral side of the longitudinal axis of the sole toward a medial edge of the sole, and wherein, in the common origin, the plurality of sipes do not fully surround the plurality of segments, defining regions of attachment between the plurality of segments, the heel portion, and the forefoot portion of the sole;
wherein the common origin is disposed along an arch of the sole;
wherein the segmentation zone is configured such that a flexibility of the sole is at least partially a function of compression within the plurality of sipes; and
wherein the segmentation zone is configured such that flexing the sole increases a length of the sole.

9. The sole of claim 8, wherein the plurality of sipes includes at least three sipes.

10. The sole of claim 8, wherein each of the plurality of segments is triangular in shape.

11. The sole of claim 10, wherein at least one of the plurality of segments is tapered such that a medial end is wider than a lateral end in two dimensions.

12. The sole of claim 8, wherein the sole comprises a midsole and an outsole.

13. The sole of claim 12, wherein the midsole comprises polyurethane.

14. The sole of claim 12, wherein the outsole comprises rubber.

15. The sole of claim 8, wherein the at least a portion of the plurality of segments are substantially pyramidal from medial edge to lateral edge, having a roughly square base disposed along the medial edge of the sole.

16. The sole of claim 8, wherein the ground-contacting surfaces and the top surfaces of the at least a portion of the plurality of segments are triangular.

17. A sole for an article of footwear, the sole comprising:
a heel portion;
a forefoot portion; and
a segmentation zone disposed between the heel portion and the forefoot portion, the segmentation zone disposed generally orthogonal to a longitudinal axis of the sole, the segmentation zone including two wing segments separated from each other and from the heel and forefoot portions by a plurality of sipes extending transverse to the longitudinal axis of the sole, wherein the plurality of sipes radiate outward from a common region disposed on a lateral side of a longitudinal axis of the sole toward a medial edge of the sole, and wherein, in the common region, the plurality of sipes do not fully surround the two wing segments, defining regions of attachment between the two wing segments, the heel portion, and the forefoot portion of the sole; and
wherein the segmentation zone is configured such that the sole compresses and expands as a function of compression and expansion within one or more sipes of the plurality of sipes.

18. The sole of claim 17, wherein the common region is disposed along an arch of the sole.

19. The sole of claim 17, further comprising a notch disposed at a lateral edge of the sole near the common region.

20. The sole of claim 17, wherein each sipe of the plurality of sipes is tapered such that a medial end is wider than a lateral end.

* * * * *